US008627693B1

(12) United States Patent
Haber

(10) Patent No.: US 8,627,693 B1
(45) Date of Patent: Jan. 14, 2014

(54) CARGO DOOR SIDE LOCK ASSEMBLY

(71) Applicant: Greg Haber, Wodbury, NY (US)

(72) Inventor: Greg Haber, Wodbury, NY (US)

( * ) Notice: Subject to any disclaimer, the term of this patent is extended or adjusted under 35 U.S.C. 154(b) by 0 days.

(21) Appl. No.: 13/768,712

(22) Filed: Feb. 15, 2013

Related U.S. Application Data

(60) Provisional application No. 61/672,876, filed on Jul. 18, 2012.

(51) Int. Cl.
*E05B 73/00* (2006.01)

(52) U.S. Cl.
USPC ..... 70/14; 70/56; 70/417; 70/201; 70/212; 292/212; 292/DIG. 32

(58) Field of Classification Search
USPC ..... 70/14, 54–56, 417, 201–203, 211, 212, 70/DIG. 43; 292/218, 259 R, 211, 212, 292/DIG. 32
See application file for complete search history.

(56) References Cited

U.S. PATENT DOCUMENTS

| | | | | | |
|---|---|---|---|---|---|
| 5,029,909 | A * | 7/1991 | Bunger | 292/40 |
| 5,168,258 | A * | 12/1992 | Radke | 340/542 |
| 5,509,700 | A * | 4/1996 | Kennedy, Jr. | 292/3 |
| 5,735,146 | A * | 4/1998 | Taplin | 70/56 |
| 6,581,419 | B1 * | 6/2003 | Strodtman | 70/56 |
| 6,581,425 | B1 * | 6/2003 | Brown et al. | 70/212 |
| 6,592,155 | B1 * | 7/2003 | Lemley et al. | 292/7 |
| 6,698,806 | B2 * | 3/2004 | Brammall et al. | 292/286 |
| 6,705,136 | B2 * | 3/2004 | Porter | 70/210 |
| 7,066,500 | B2 * | 6/2006 | Haber | 292/106 |
| 7,073,357 | B2 * | 7/2006 | Nixon, Jr. | 70/56 |
| 7,234,755 | B1 * | 6/2007 | Senn et al. | 296/146.1 |
| 7,735,884 | B2 * | 6/2010 | Bacco et al. | 292/340 |
| 7,997,630 | B2 * | 8/2011 | Lemley et al. | 292/36 |
| 8,011,213 | B1 * | 9/2011 | Gogel | 70/56 |
| 2004/0221626 | A1 * | 11/2004 | Palzkill et al. | 70/34 |
| 2005/0144991 | A1 * | 7/2005 | Bravo et al. | 70/56 |
| 2007/0200362 | A1 * | 8/2007 | Bacco et al. | 292/218 |

* cited by examiner

*Primary Examiner* — Suzanne Barrett
(74) *Attorney, Agent, or Firm* — Epstein Drangel, LLP; Roert L. Epstein

(57) ABSTRACT

A lock assembly for a container having an opening defined by a door jamb, a cargo door adapted to close the opening, a rod linearly moveable to engage the door jamb, and a latch mountable to the rod. The assembly includes a casing having an inclined opening and mounted to the cargo door parallel the rod. The casing includes a protrusion changeable between an extended and a retracted position. A latch receiving means has an inclined opening adapted to align with the inclined opening of the casing for accepting the latch therein. The latch receiving means is responsive to movement of the latch within the casing between a locked and an unlocked condition and engages the locking means when the latch receiving means is in the locked condition.

The rod is moved by the latch to engage and disengage the door jamb.

14 Claims, 4 Drawing Sheets

CARGO DOOR SIDE LOCK ASSEMBLY

CROSS-REFERENCE TO RELATED APPLICATION

This application claims the benefit of provisional patent application Ser. No. 61/672,876 filed in the United States Patent and Trademark Office on Jul. 18, 2012.

BACKGROUND OF THE INVENTION

1. Field of the Invention

This invention relates generally to a door lock for an enclosed cargo area of a vehicle, and more particularly, to an improved side lock assembly for a swing-out cargo door configured to secure and controllably provide access to the cargo area by means of a protrusion engaged by a rotatable latch fixed to a lock rod, such that the rod is moved by the latch to engage and disengage a door jamb.

2. Description of the Related Art

Vehicles, aircraft, truck trailers, ships, and the like, are used to transport valuable cargo within their containers from one destination to another. These transports secure the cargo within their containers, and the cargo is only accessible via a locking swing-out door. A variety of different locks for existing swing-out doors have been fashioned, but burglars have found simple ways to rob and tamper with these locks in order to steal valuable cargo.

Thus, while these units may be suitable for the particular purpose employed, or for general use, they would not be as suitable for the purposes of the present invention as disclosed hereafter.

It is, therefore, a primary object of the present invention to provide an improved side lock assembly for a swing-out cargo door configured to uniquely secure valuable cargo and controllably and efficiently provide access to the cargo area.

It is, therefore, another object of the present invention to provide an improved side lock assembly having a physically protected locking means for preventing theft from tampering or cutting the lock off by a burglar.

It is, therefore, another object of the present invention to provide a side lock assembly capable of being installed on any transportation apparatus having an opening defined by a door jamb and a swing-out cargo door adapted to close the opening.

BRIEF SUMMARY OF THE INVENTION

In accordance with one aspect of the present invention, a lock assembly for a vehicle is provided having an opening defined by a door jamb, a cargo door adapted to close the opening, a rod linearly moveable to engage the door jamb, and a latch mountable to the rod.

The system includes a casing adapted to receive the latch, means for mounting the casing to the cargo door and locking means changeable between a locked and an unlocked condition.

A latch receiving means is responsive to movement of the latch within the casing between a locked and an unlocked condition and operably engages the locking means when the latch receiving means is in the locked condition.

The latch receiving means may be a housing. The casing and the housing may each include an inclined opening, wherein both the openings are inclined relative to horizontal. The openings of the casing and housing are substantially aligned in the unlocked condition. The openings of the casing and housing are out of alignment in the locked condition. The latch receiving means is permitted to move within the casing while in the unlocked condition, and prohibited from moving within the casing while in the locked condition.

A spring-loaded protrusion is within the casing for movement between an extended and a retracted position. The spring-loaded protrusion is held in the retracted position within the casing when the housing is in the unlocked condition. The latch moves the housing from the unlocked to the locked condition as the spring-loaded protrusion moves from the retracted position to the extended position. The spring-loaded protrusion is held in the extended position within the casing and interferes with movement of the housing while the housing is in the locked condition.

In accordance with an additional embodiment, a door lock assembly for a container is provided having an opening defined by a door jamb, a cargo door having an exterior surface adapted to close the opening, a rod linearly moveable to engage the door jamb, and a latch mounted to the rod.

The assembly includes a casing having an inclined opening and mounted to the exterior surface of the cargo door parallel the rod.

A latch receiving means has an inclined opening aligned with the inclined opening of the casing and is responsive to movement when the latch receiving means moves between a locked and an unlocked condition.

A protrusion is moveable between an extended position and a retracted position.

The inclined openings of the casing and the latch receiving means align to accept the latch therein when the latch receiving means is in the unlocked condition.

The protrusion is held in the extended position within the casing and interferes with movement of the latch receiving means while the latch receiving means is in the locked condition. Preferably, the protrusion is spring-loaded.

The protrusion is held in the retracted position within the casing when the latch receiving means is in the unlocked condition.

In accordance with an additional embodiment, a lock assembly for a vehicle has an opening defined by a door jamb and a cargo door adapted to close the opening.

The assembly includes a rod linearly moveable to engage the door jamb, a latch mounted to the rod, and a hollow casing having a front wall, opposing side walls, an inclined opening, means for mounting the casing to the cargo door parallel the rod and at a position with the inclined opening adapted to receive the latch.

A latch receiving means is contained within the casing having a front wall, a back wall, opposing side walls, and an inclined opening adapted to align with the inclined opening of the casing and adapted to receive the latch therein and responsive to movement of the latch receiving means between a locked and an unlocked condition. The latch receiving means may be a housing.

A spring-loaded protrusion is within the casing for movement between an extended and a retracted position.

The inclined openings of the casing and the latch receiving means align to accept the latch therein when the latch receiving means is in the unlocked condition.

The spring-loaded protrusion is held in the retracted position within the casing when the latch receiving means is in the unlocked condition.

The latch moves the latch receiving means from the unlocked to the locked condition, as the spring-loaded protrusion moves from the retracted position to the extended position.

The spring-loaded protrusion is held in the extended position within the casing and interferes with movement of the latch receiving means while the latch receiving means is in the locked condition.

BRIEF DESCRIPTION OF THE SEVERAL VIEWS OF THE DRAWINGS

To these and to such other objects that may hereinafter appear, the present invention relates to an improved side lock assembly for a swing-out cargo door configured to uniquely secure valuable cargo and controllably and efficiently provide access to the cargo area, as described in detail in the following specification and recited in the annexed claims, taken together with the accompanying drawings, in which like numerals refer to like parts in which:

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

DETAILED DESCRIPTION OF THE INVENTION

Figure 1:
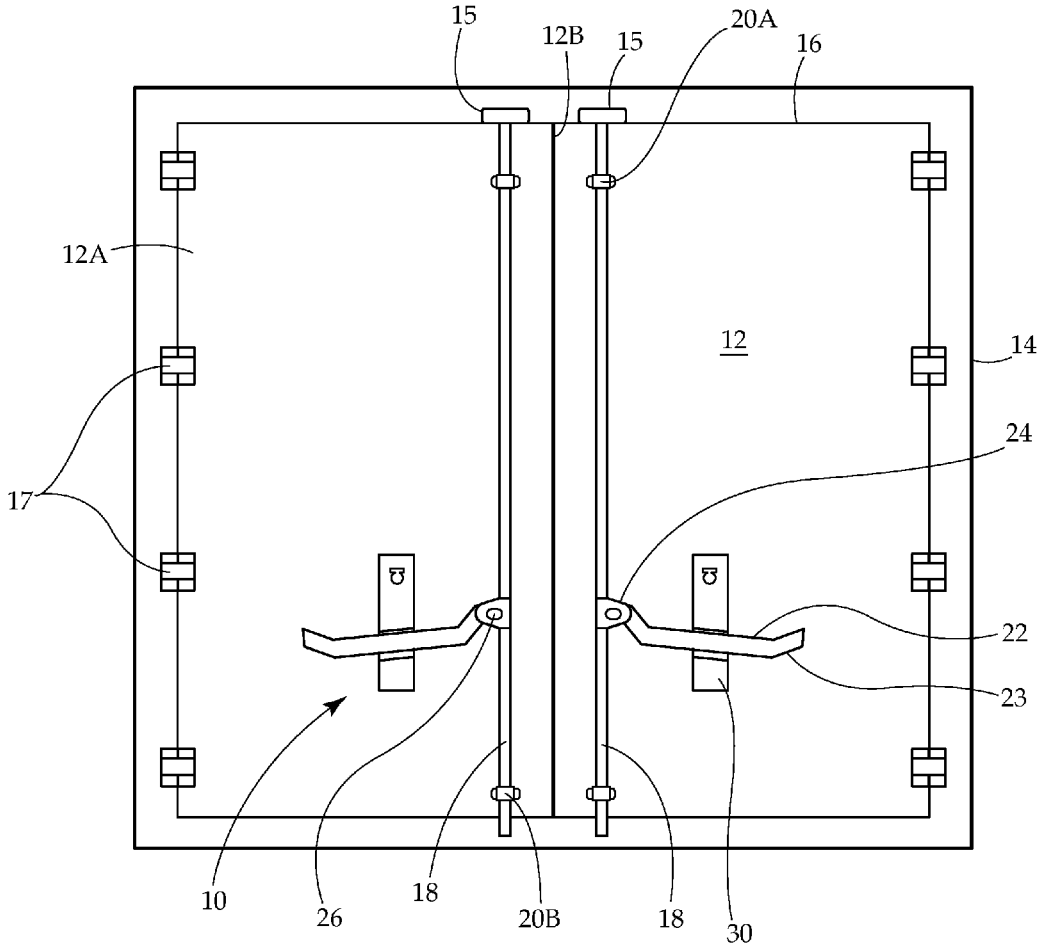
FIG. 1 is a plan view of an opening of a vehicle defined by a door jamb, wherein a swing-out cargo door closes the opening according to an embodiment of the present invention.

The present invention illustrated in FIG. 1 is directed to an improved side lock assembly 10 for use installed on a swing-out cargo door 12 of a container 14. The container 14 may be transported or integrated within any vehicle. The vehicle includes any transportation means, included but not limited to, automobiles, trucks, aircrafts, and ships. The container 14 includes an opening 16 defined by a door jamb 15. The cargo door 12 is supported by a series of hinges 17 along its outer edge 12A, and is adapted to close the opening 16.

A rod 18 is linearly moveable to engage the door jamb 15 and is secured adjacent the inner edge 12B of the door 12 by top and bottom support members 20A and 20B for rotating about its own axis. A latch 22 is mounted to a side of the vertical rod 18 for opening and closing the cargo door 12. In particular, the rod 18 is moved by the latch 22 to engage or disengage the door jamb 15. Preferably, a hinge 24 is welded to the side of the rod 18 and securely couples the latch 22 to the rod 18 via a bolt 26. The latch 22 is preferably made of steel and substantially U-shaped.

The assembly 10 includes a casing 30 adapted to receive the latch 22, and capable of being mounted to the cargo door 12 parallel the rod 18. In alternate embodiments, the latch 22 is straight, or any other suitable shape, adapted for secure insertion within the housing.

Figure 2:
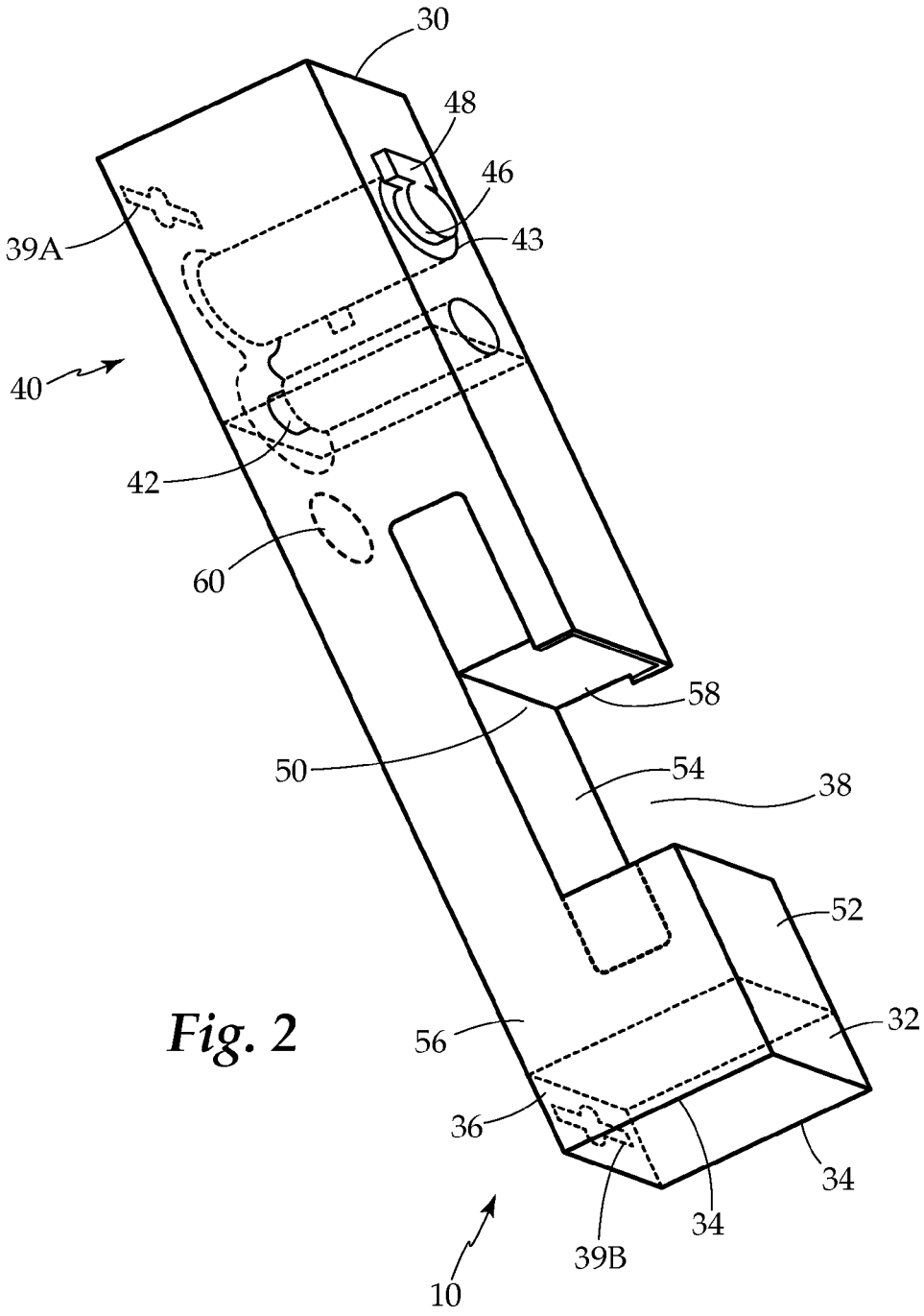
FIG. 2 is a top side perspective view illustrating a side lock assembly according to an embodiment of the present invention for the swing-out cargo door of FIG. 1.

FIG. 2 illustrates the side lock assembly 10 wherein the casing 30 has a locking system 40 for changing between a locked or engaged position and an unlocked or disengaged position. The assembly 10 includes a latch receiving means 50, preferably a housing, contained within the casing 30, and responsive to movement from the latch 22 within the casing 30 to move between the locked and the unlocked condition. The latch 22 causes the housing 50 to engage the locking system 40 when the housing 50 is in the locked condition and simultaneously causes the rod 18 to engage the door jamb 15.

The casing 30 is a substantially hollow rectangular casing, having a front wall 32, opposing side walls 34, and a flat back wall 36. An inclined opening 38 extends along the casing 30 for receiving the latch 22 therein. Preferably, the opening 38 is inclined relative to horizontal. The flat back wall 36 of the casing 30 includes at least one opening 39 for mounting the casing 30 to the cargo door 12 at a position that allows the inclined opening 38 to receive the latch 22. Preferably, the flat back wall 36 includes an upper and a lower opening 39A and 39B for accepting a bolt, screw or other like fastener therethrough, such that the casing 30 is securely mounted to the cargo door 12.

The housing 50 is substantially contained within the casing 30 and includes a front wall 52, opposing side walls 54, a back wall 56, and an inclined opening 58. Preferably, the opening 58 is inclined relative to horizontal.

Figure 3:
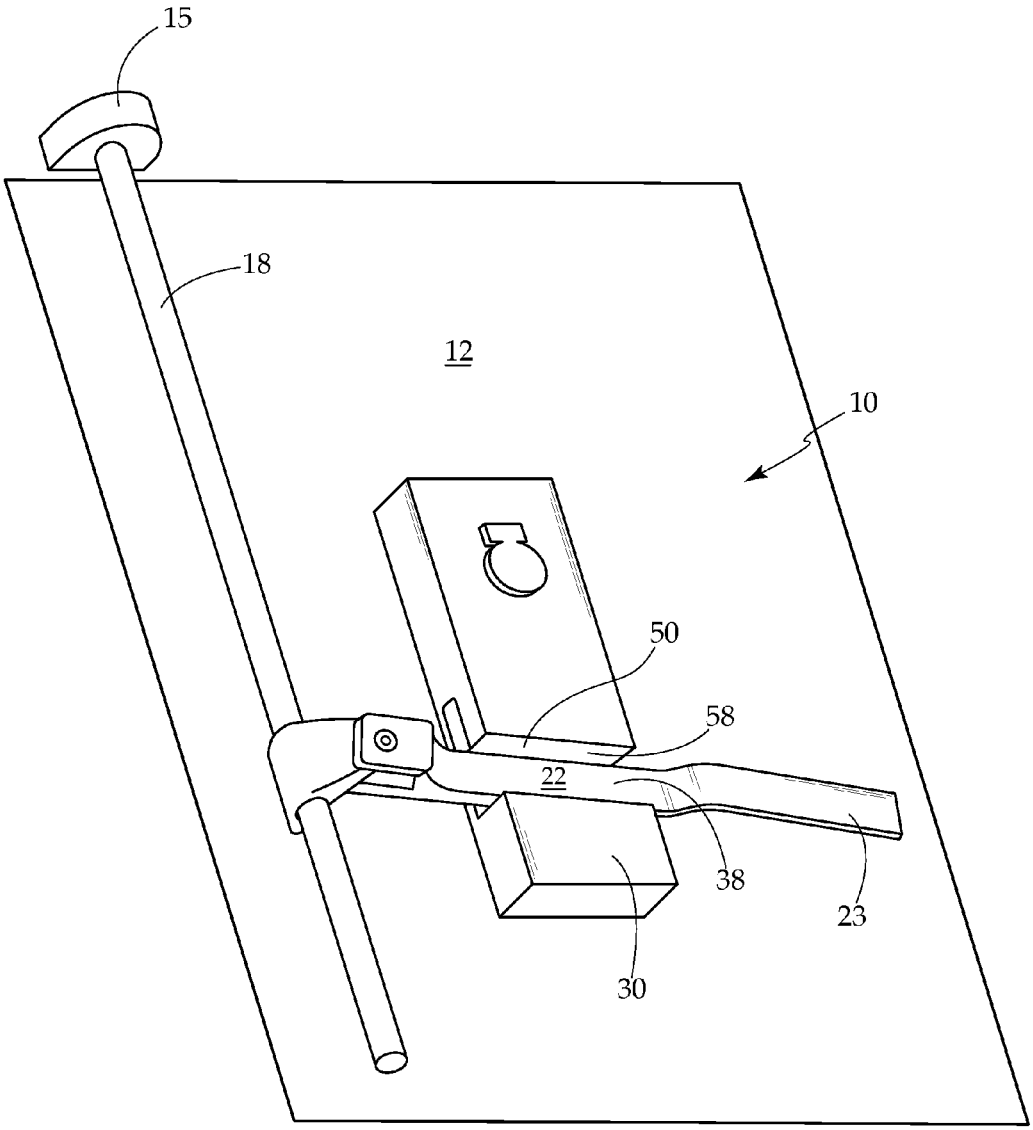
FIG. 3 is a front perspective view of the side lock assembly of FIG. 2, mounted to the cargo door in an unlocked condition.

The locking system 40 includes a protrusion 42, preferably cylindrical and spring-loaded. The protrusion 42 is moveable within the casing 30 between an extended position when the housing 50 is in the locked condition (FIG. 4) and a retracted position when the housing 30 is in the unlocked condition (FIGS. 2 and 3). The protrusion 42 is held in the retracted position within the casing 30 and allows the latch 22 to move the housing 50 within the casing 30, while in the unlocked condition. The protrusion 42 is held in the extended position within the casing 30, while in the locked condition. Preferably, the protrusion 42 extends through the casing 30 and through an opening 60 in the housing 50, to interfere and prohibit movement of the housing 50.

FIG. 3 illustrates the side lock assembly 10 when the housing 50 is in the unlocked condition. Here, the inclined opening 58 of the housing 50 aligns with the inclined opening 38 of the casing 30, such that the casing and housing 30 and 50 are adapted to receive the latch 22 therein. While in the unlocked condition, the housing 50 is able to move within the casing 30.

After the latch 22 is secured within the aligned inclined openings 38 and 58, the latch 22 is engaged to move the housing 50 within the casing 30 from the unlocked condition to the locked condition. Preferably, pushing upwardly on a handle 23 of the latch 22 causes the protrusion 42 of the locking system 40 to engage. As the latch 22 is inserted within the inclined openings 38 and 58, the rod 18 simultaneously rotates toward the assembly 10, and as the latch 22 moves upwardly, the rod 18 simultaneously engages the door jamb 15. Thus, the swing-out cargo door 12 is securely locked closed.

Figure 4:
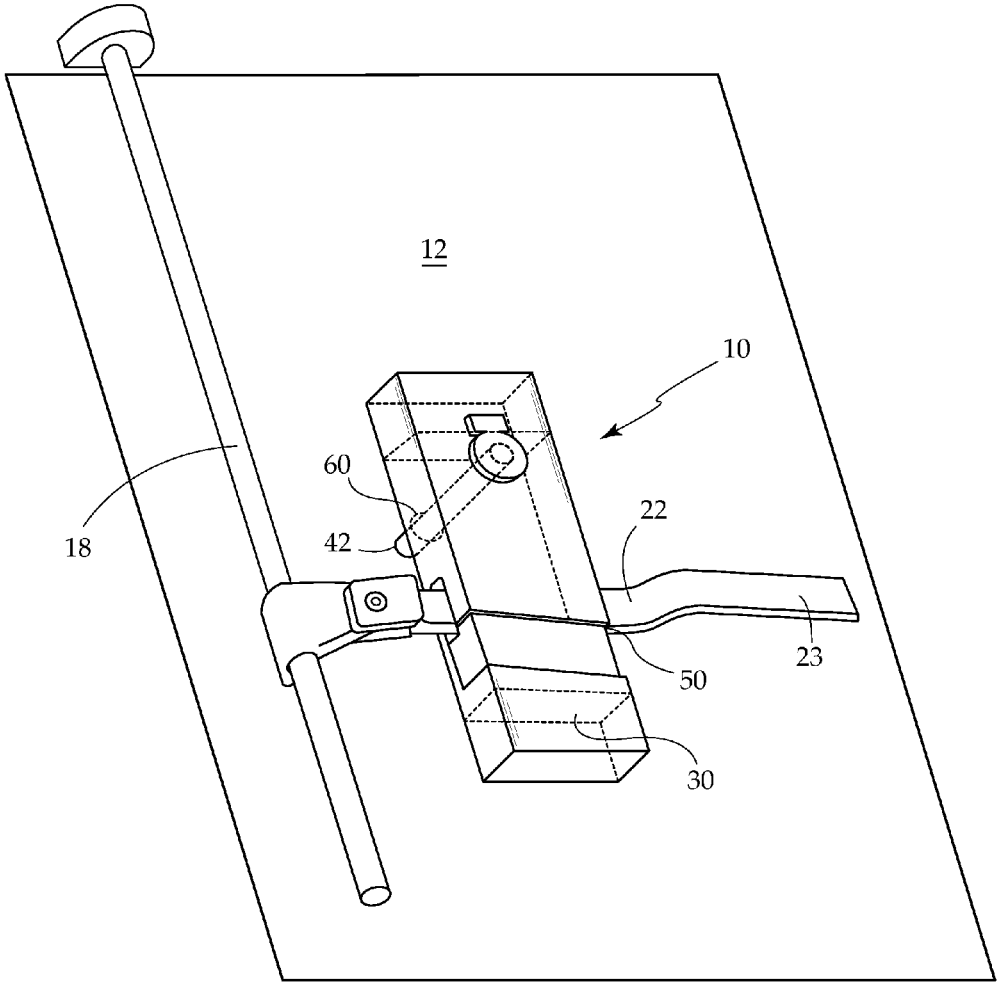
FIG. 4 is a front perspective view of the side lock assembly of FIG. 2, mounted to the cargo door in a locked condition.

FIG. 4 illustrates the side lock assembly 10 when the housing 50 is in the locked condition. Here, the inclined opening 58 of the housing 50 is not aligned with the inclined opening 38 of the casing 30. While in the locked condition, the housing 50 is prohibited from moving within the casing 30.

Pushing upwardly on the handle 23 of the latch 22 while accepted within the inclined opening 58 of the housing 50 actuates the protrusion 42, preferably piston driven, to extend outwardly through the opening 60 in the housing 50 and interfere with movement of the housing 50. Thus, while in the locked condition, the protrusion 42 extends through the casing 30 and through the opening 60 in the housing 50, to interfere and prohibit movement of the housing 50. Preferably, the opening 60 is cylindrical and adapted to securely accept the cylindrical protrusion 42.

Preferably, the casing 30 accommodates the protrusion 42 for movement between the extended and retracted positions relative to the locked and unlocked conditions of the housing 50 respectively. The locking system 40 controls movement of the protrusion 42 by a mechanism 43 for controlling entry (shown in FIG. 2). The mechanism 43 may be actuated electronically or manually by means such as, but not limited to, a keypad, keycard, wireless key, smart phone, fingerprint or voice command. In FIG. 2, the mechanism 43 includes a key (not shown) insertable through a key receptacle 46 along the front wall 32 of the casing 30. The key receptacle 46 may include a hinged cover 48, which is pivotally movable between an open position (not shown) and a closed position (shown in FIG. 2). A retaining nut, bolt, screw or other like fastener secures the mechanism 43 to the front wall 32 of the casing 30.

U.S. Pat. No. 7,066,500 entitled Vehicle Door Lock, issued Jun. 27, 2006 is directed toward a lock having a locking mechanism similar to the locking system 40 disclosed herein. While other systems are contemplated, the locking mechanism of the '500 patent is preferred for use within the present embodiment.

Once the locking system 40 is fully engaged, the protrusion 42 holds the housing 50 within the casing 30 securely and free from movement. When a user inserts the key into the key receptacle 46 and turns the key, the protrusion 42 retracts within the casing 30 and disengages the latch 22. This causes the latch 22 and housing 50 to move within the casing, preferably slide downwardly, such that the inclined openings 38 and 58 of the casing 30 and housing 50 re-align, thereby unlocking the assembly 10 and allowing the latch 22 to be released.

When the casing 30 is installed vertically on a cargo door 12, and the protrusion 42 retracts within the casing 30 to unlock the assembly, action of gravity causes the housing 50 to automatically drop downward into the unlocked position.

Preferably, each cargo door 12 includes the assembly 10 with casing 30 thereon for locking that cargo door closed. In FIG. 1, the vehicle includes adjacent swing-out cargo doors and the assembly 10 is preferably included on each cargo door. In alternate embodiments, only one assembly 10 may be utilized. In particular, one of the cargo doors 12 may be locked in the closed position by any conventional method, and the assembly may be included on the opposite door only.

In conclusion, herein is presented the improved side lock assembly for a swing-out cargo door configured to uniquely secure valuable cargo and controllably and efficiently provide access to the cargo area. The invention is illustrated by example in the drawing figures, and throughout the written description. It should be understood that numerous variations are possible, while adhering to the inventive concept. Such variations are contemplated as being a part of the present invention. While only a limited number of preferred embodiments of the present invention have been disclosed for purposes of illustration, it is obvious that many modifications and variations could be made thereto. It is intended to cover all of those modifications and variations, which fall within the scope of the present invention as defined by the following claims.

I claim:

1. A lock assembly for a container having an opening defined by a door jamb, a cargo door adapted to close said opening, a rod linearly moveable to engage said door jamb, and a latch mountable to said rod, said lock assembly comprising:

a casing adapted to receive said latch, means for mounting said casing to said cargo door, and locking means changeable between a locked and an unlocked condition; and a housing responsive to movement of said latch within said casing between a locked and an unlocked condition and operably engaging said locking means when in said locked condition.

2. The lock assembly of claim 1, wherein said casing and said housing each include an inclined opening, wherein both said openings are inclined relative to horizontal.

3. The lock assembly of claim 2, wherein said openings of said casing and housing are substantially aligned in said unlocked condition.

4. The lock assembly of claim 2, wherein said openings of said casing and housing are out of alignment in said locked condition.

5. The lock assembly of claim 4, wherein said housing is permitted to move within said casing while in said unlocked condition, and prohibited from moving within said casing while in said locked condition.

6. The lock assembly of claim 1, further comprising a spring-loaded protrusion within said casing for movement between an extended and a retracted position.

7. The lock assembly of claim 6, wherein said spring-loaded protrusion is held in the retracted position within said casing when said housing is in said unlocked condition.

8. The lock assembly of claim 7, wherein said latch moves said housing from the unlocked to the locked condition and said spring-loaded protrusion moves from said retracted position to said extended position.

9. The lock assembly of claim 8, wherein said spring-loaded protrusion is held in said extended position within said casing and interferes with movement of said housing while said housing is in said locked condition.

10. A door lock assembly for a container having an opening defined by a door jamb, a cargo door having an exterior surface adapted to close said opening, a rod linearly moveable to engage said door jamb, and a latch mounted to said rod, the assembly comprising:

a casing having an inclined opening and mounted to the exterior surface of said cargo door parallel said rod;

a latch receiving means having an inclined opening aligned with said inclined opening of said casing and wherein said latch receiving means moves between a locked and an unlocked condition; and a protrusion moveable between an extended position and a retracted position, wherein said inclined openings of said casing and said latch receiving means align to accept said latch therein when said latch receiving means is in said unlocked condition, wherein said protrusion is held in said extended position within said casing and interferes with movement of said latch receiving means while said latch receiving means is in said locked condition.

11. The door lock assembly of claim 6, wherein the protrusion is spring-loaded.

12. The door lock assembly of claim 6, wherein the protrusion is held in the retracted position within said casing when said latch receiving means is in said unlocked condition.

13. A lock assembly for a vehicle having an opening defined by a door jamb and a cargo door adapted to close said opening, the assembly comprising:

a rod linearly moveable to engage said door jamb;

a latch mounted to said rod;

a hollow casing having a front wall, opposing side walls, an inclined opening, means for mounting said casing to said cargo door parallel said rod and at a position with said inclined opening adapted to receive said latch;

a latch receiving means contained within said casing having a front wall, a back wall, opposing side walls, and an inclined opening adapted to align with said inclined opening of said casing and adapted to receive said latch therein and responsive to movement from said latch between a locked and an unlocked condition; and a spring-loaded protrusion within said casing for movement between an extended and a retracted position, wherein said inclined openings of said casing and said latch receiving means align to accept said latch therein when said latch receiving means is in said unlocked condition, wherein said spring-loaded protrusion is held in the retracted position within said casing when said latch receiving means is in said unlocked condition, wherein said latch moves said latch receiving means from an unlocked to a locked condition, wherein said spring-loaded protrusion moves from said retracted position to said extended position, wherein said spring-loaded protrusion is held in said extended position within said casing and interferes with movement of said latch receiving means while said latch receiving means is in said locked condition.

14. The lock assembly for a vehicle of claim 13, wherein the latch receiving means is a housing.

* * * * *